US006196236B1

(12) United States Patent
Imai et al.

(10) Patent No.: US 6,196,236 B1
(45) Date of Patent: Mar. 6, 2001

(54) ULTRASONIC HAIR CURLING DEVICE

(75) Inventors: Takeshi Imai, Neyagawa; Yasuhiro Sato, Suita; Izumi Mihara, Daito; Hiromitsu Inoue, Kyoto; Hideo Iwata, Kyotanabe; Yoshiki Isogai; Masahiko Adachi, both of Hikone; Yasushi Arikawa; Hideaki Abe, both of Neyagawa; Shosuke Akisada, Shijonawate, all of (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/147,586

(22) PCT Filed: Jun. 30, 1998

(86) PCT No.: PCT/JP98/02917

§ 371 Date: Jan. 27, 1999

§ 102(e) Date: Jan. 27, 1999

(87) PCT Pub. No.: WO99/00034

PCT Pub. Date: Jan. 7, 1999

(30) Foreign Application Priority Data

Jun. 30, 1997 (JP) ..... 9-174692
Oct. 28, 1997 (JP) ..... 9-294735

(51) Int. Cl.[7] ..... A45D 2/12

(52) U.S. Cl. ..... 132/226; 132/223; 132/245; 219/222

(58) Field of Search ..... 132/210, 226, 132/211, 227, 229, 232, 269, 245, 223; 219/222, 242, 495, 521

(56) References Cited

U.S. PATENT DOCUMENTS

| | | | | |
|---|---|---|---|---|
| 3,001,530 | * | 9/1961 | Julian | 132/226 |
| 3,211,159 | * | 10/1965 | Goble | 132/226 |
| 3,393,686 | | 7/1968 | Goble . | |
| 3,526,234 | | 9/1970 | Chrablow . | |
| 3,802,443 | | 4/1974 | Morane . | |
| 4,023,579 | * | 5/1977 | Suroff | 132/226 |
| 4,695,095 | * | 9/1987 | Barowski et al. | 132/226 |
| 4,742,835 | * | 5/1988 | Boweter | 132/226 |
| 5,875,789 | * | 3/1999 | Shigihara | 132/210 |

FOREIGN PATENT DOCUMENTS

| | | |
|---|---|---|
| 8-229046 | 11/1996 | (JP) . |
| WO96/35350 | 11/1996 | (WO) . |

* cited by examiner

*Primary Examiner*—Pedro Philogene
(74) *Attorney, Agent, or Firm*—Arent Fox Kintner Plotkin & Kahn PLLC

(57) ABSTRACT

An ultrasonic hair curling device capable of applying ultrasonic vibration efficiently to hairs for effective hair styling in a short time. The device includes a housing, an ultrasonic generator incorporated in the housing for generating ultrasonic vibrations, and a horn connected to receive and transmit the ultrasonic vibrations. The horn is formed at its end with a hollow barrel which projects from the housing for receiving therearound a strand of hair to be curled. The hollow barrel is provided at a portion intermediates at its longitudinal ends with a hair winding zone of which cross-section is smaller than the other portion of the hollow barrel. The hair winding zone of the reduced cross section can vibrate at an amplitude larger than at the front end of the barrel for applying the ultrasonic vibrations efficiently to the hair and making the hair curling effectively.

11 Claims, 4 Drawing Sheets

ULTRASONIC HAIR CURLING DEVICE

TECHNICAL FIELD

The present invention is directed to an ultrasonic hair curling device, and more particularly to the ultrasonic hair curling device for curling the hair into coils or spirals by application of ultrasonic vibrations.

BACKGROUND ART

A hair curling device for curling the hair by application of ultrasonic vibrations is disclosed in Japanese Laid-Open Publication No. 8-299046. The device includes a hollow barrel which is formed at one end of a horn transmitting ultrasonic vibrations and around which the hair is wound, so that a hair curling is made by the ultrasonic vibrations transmitted through the barrel. However, in spite of that a hair winding portion is made hollow in order to increase the vibration, a maximum amplitude of vibration occurs at the end of the hollow barrel. Therefore, the middle portion of the barrel actually receiving the hair therearound will not give sufficient ultrasonic vibrations to the hair, resulting in a low energy transmission.

DISCLOSURE OF THE INVENTION

The present invention has been accomplished in order to reduce the above problem and has an object of providing an ultrasonic hair curling device which is capable of efficiently applying the ultrasonic vibration from a limited ultrasonic energy for attaining the effective hair curling in a short time.

The ultrasonic hair curling device in accordance with the present invention includes a housing, an ultrasonic generator incorporated in the housing for generating ultrasonic vibrations, and a horn connected to receive and transmit the ultrasonic vibrations. The horn is formed at its end with a hollow barrel which projects from the housing for receiving therearound a strand of hair to be curled. The main feature of the present invention resides in that the hollow barrel is provided at a portion intermediates at its longitudinal ends with a hair winding zone of which cross-section is smaller than the other portion of the hollow barrel. The hair winding zone of the reduced cross section can vibrate at an amplitude larger than at the front end of the barrel for applying the ultrasonic vibrations efficiently to the hair and making the hair curling effectively.

The hair winding zone may be configured to have a cross-section which is smaller towards a lengthwise center of the hair winding zone than at opposite lengthwise ends of said hair winding zone, or to have a uniform cross-section over its full longitudinal length thereof.

Also, the hair winding zone of reduced cross-section can be realized by a recess formed in an outer surface, an inner surface, or both surfaces of the hollow barrel.

Further, the hair winding zone of reduced cross-section can be realized by provision of a plurality of slits which extend in the axial direction of the hollow barrel and which are spaced circumferentially around the hollow barrel. Defined between the circumferentially spaced adjacent slits are reeds which vibrate in a radial direction as well as in the lengthwise direction of said hollow barrel. Each slit has such a length that causes the reeds to vibrate around at a resonant frequency of said horn when the strand of hair is wound around the hair winding zone. Whereby, the hair winding zone can develop radial vibrations, in addition to having increased the vibration amplitude, for attaining hair curling at an improved efficiency.

The slits have such a length that causes the reeds to vibrate at a frequency higher than the resonant frequency of the horn under a no load condition where the hair winding zone receives no strand of hair.

The hollow barrel may be formed along its length with a plurality of slit groups each composed of the circumferentially spaced slits barrel so that the hair winding portion can extends over a long distance within the length of the barrel without substantially lowering a strength of the barrel. The slits may be arranged in a manner that the slits in one slit group are longitudinally aligned with the slits in the adjacent slit group, or the slits in one slit group are staggered in the circumferential direction with respect to the slits in the adjacent slit group.

In order to avoid the slit from having at the corners thereof an origin of fracture due to stress concentration, each slit is configured to have rounded corners. In addition, each slit may have its periphery surrounded by a reinforcement frame which gives an additional thickness to said periphery of the slit.

Further, the hollow barrel may be additionally formed at its front end with a plurality of open slits. The open slits extend in the lengthwise direction of the hollow barrel and are spaced circumferentially around the hollow barrel to define additional reeds between the circumferentially adjacent open slits, which additional reeds can apply radial vibrations for more improved hair curling.

BEST MODES FOR CARRYING OUT THE INVENTION

Figure 1:
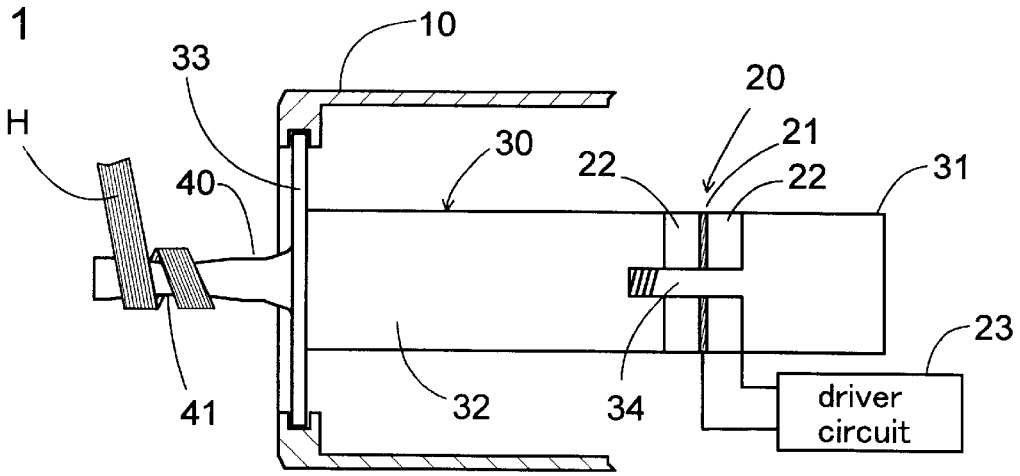
FIG. 1 is a schematic view of an ultrasonic hair curling device in accordance with one embodiment of the present invention.

Referring to FIG. 1, there is shown an ultrasonic hair curling device in accordance with one embodiment of the present invention which includes a housing 10 accommodating therein an ultrasonic vibrator 20. Connected to the ultrasonic vibrator 20 is a horn 30 from which a hollow barrel 40 projects for winding a strand of hair H therearound. The vibrator 20 includes a pair of piezoelectric elements 22 on opposite sides of an electrode plate 21 and is held between the horn 30 and a fixture 31. The fixture 31 has a bolt 34 which penetrates through the vibrator 20 and is secured to the rear end of the horn 30 for securing the vibrator 20 to the horn 30. The vibrator 20, upon receiving a high frequency electric signal from a driver circuit 23, generates an ultrasonic vibration along an axis of the horn and transmits the same to the horn 30. The horn 30 is made of a metal such as a titanium, aluminum, and stainless steel, or FRP (fiber-reinforced plastic) and is caused by the vibrator 20 to vibrate at a frequency of 20 kHz to 100 kHz.

The horn 30 is composed of a main body 32 received in the housing 10 and the hollow barrel 40 of circular cross-section projecting concentrically and outwardly of the housing through a cone 35. The cone 35 is of solid structure having a diameter smaller towards the hollow barrel 40 so as to amplify the vibration. A flange 33 formed between the main body 32 and the cone 35 is retained at the front end of the housing 10 for securing the horn 30 to the housing 10. The horn 30 is made into a unitary structure including the main body 32, flange 33, cone 35 and hollow barrel 40. Alternately, the hollow barrel 40 may be formed to have the flange 33 or the cone 35 an integral part thereof so as to be coupled to the main body 32 by a bolt extending through the inner bottom of the hollow barrel 40.

The main body 32 is given such an axial length that the an axial length between the center of the vibrator 20 and the flange 33 is equal to $\lambda/2$ (where $\lambda$=wavelength of the ultrasonic vibration) to form a node of vibration at the flange 33 seeing zero amplitude of vibration.

An axial length from the flange to the front end of the hollow barrel 40 is set to be $\lambda/4$. When the horn 30 is made of aluminum and is driven to give the ultrasonic vibration at 27 kHz, the length ($\lambda/4$) from the flange 33 to the front end of the hollow barrel 40 is about 50 mm. When the horn 30 is made of titanium and is driven to give the ultrasonic wave of the same frequency, the length ($\lambda/4$) is 48 mm. The length between the flange 33 and the front end of the hollow barrel 40 may be set to be $3\lambda/4$ other than $\lambda/4$, as necessary.

Figure 2:
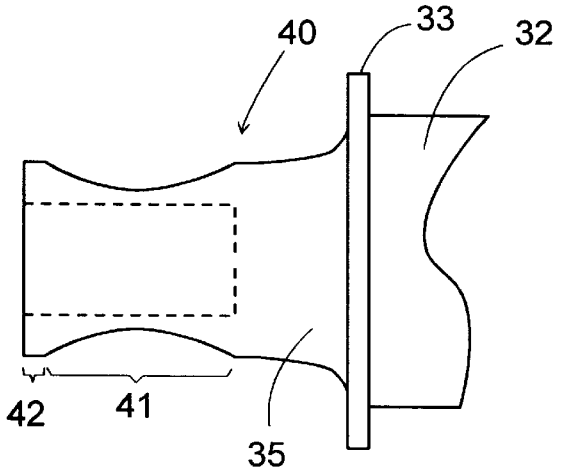
FIG. 2 is a front view of an hollow barrel at one end of a horn employed in the above device.
Figure 3:
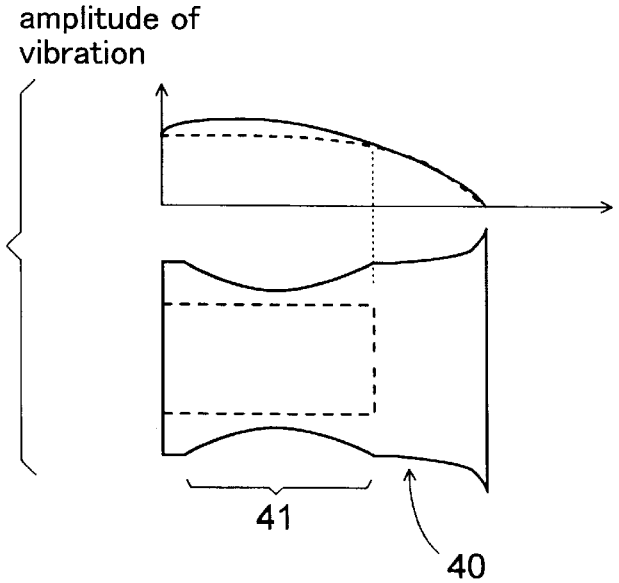
FIG. 3 is an explanatory view illustrating amplitude distribution along the axial direction of the hollow barrel.

As shown in FIG. 2, the hollow barrel 40 is formed in its axial center with a hair winding zone 41 of which cross-section is smaller than the other portion of the barrel. This hair winding zone 41 is given by provision of a recess in the outer surface of the barrel to have the cross-section which is made smaller towards the center than at the opposite ends thereof Thus, the hair winding zone 41 of reduced cross-section is given an increased ultrasonic vibration than the other portion, as indicated by solid lines of FIG. 3, thereby applying the ultrasonic vibration efficiently to the strand of the hair at the portion where the hair is wound and therefore enabling to finish the hair styling in a short time. Phantom lines of FIG. 3 show the amplitude of vibration in the absence of the hair winding zone. As shown in the figure, the provision of the hair winding zone 41 of reduced cross-section increase a maximum amplitude of vibration than otherwise. It is also made that a distal region 42 forwardly of the hair winding zone 41 is made to have a cross-section smaller than that of the cone 35 ranging from the hair winding zone 41 to the flange 33, in order to give a larger amplitude of vibration at the distal region 42 where the hair is possible wound.

Figure 4:
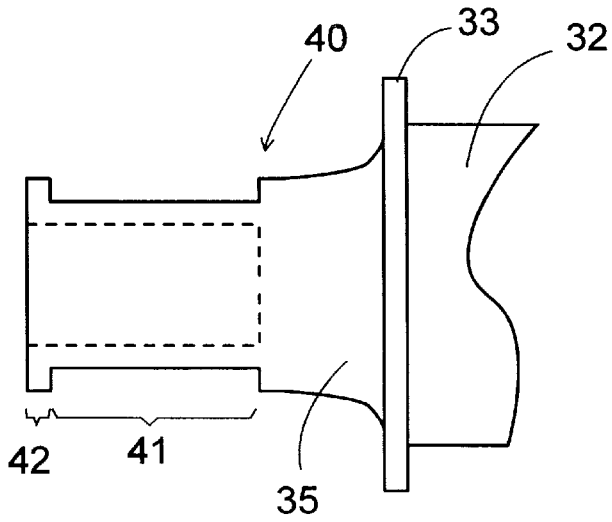
FIGS. 4, 5, and 6 are front views of other hollow barrels which may be employed in the above ultrasonic hair curling device.

As shown in FIG. 4, the hair winding zone 41 may be configured to have a uniform cross-section along the axial length thereof. In this version, the distal region 42 serves as an effective stopper for preventing the hair from slipping off the barrel.

Figure 5:
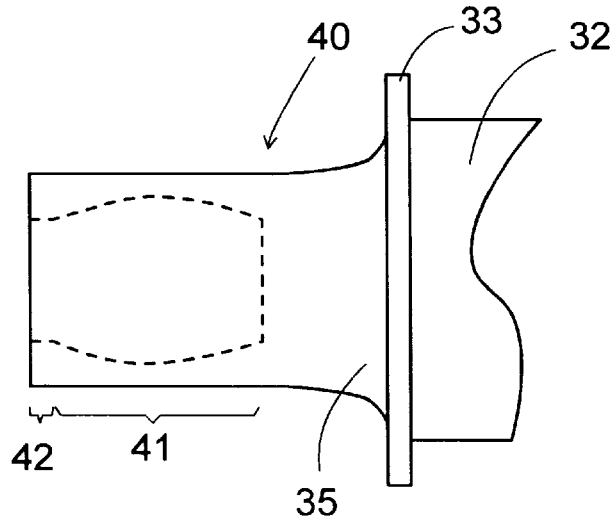
Figure 6:
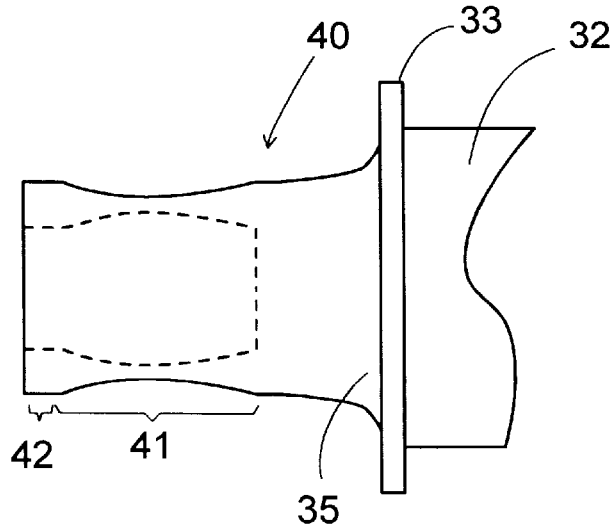

Further, the reduction of the cross-section for the hair winding zone 41 can be made by, other than the above structure, forming the recess in the inner surface of the hollow barrel 41, or forming the recesses in the outer and inner surfaces of the hollow barrel, as shown in FIGS. 5 and 6. In order to positively hold the strand of the hair wound around the hair winding zone 41, a hair clamp of known structure can be made. In this case, the flange 33 forming the node of vibration is best utilized to pivotally support the hair clamp. Any other hair holding structure can be adapted to the present invention.

Figure 8:
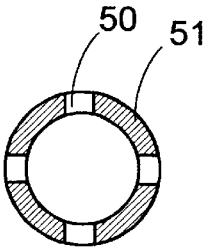
FIG. 8 is a cross section taken along line 8—8 of FIG. 7.
Figure 7:
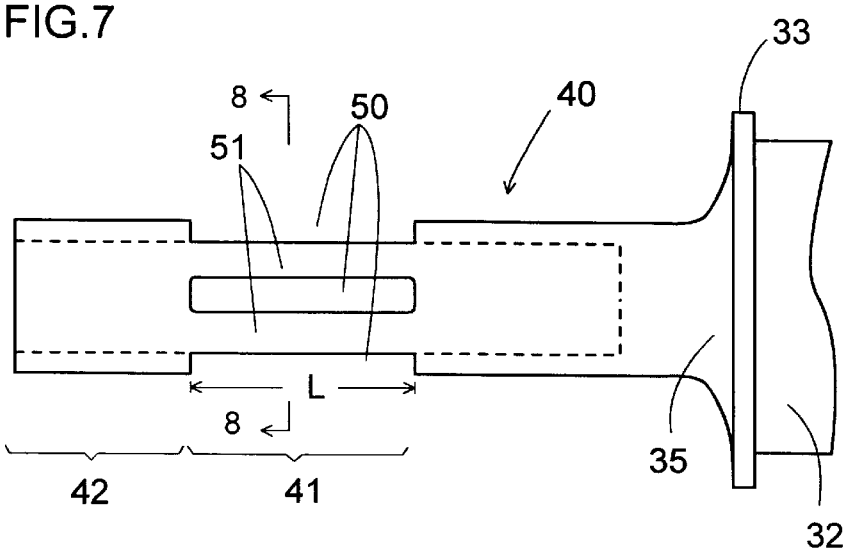
FIG. 7 is a front view of another hollow barrel which may be employed in the above ultrasonic hair curling device.
Figure 9:
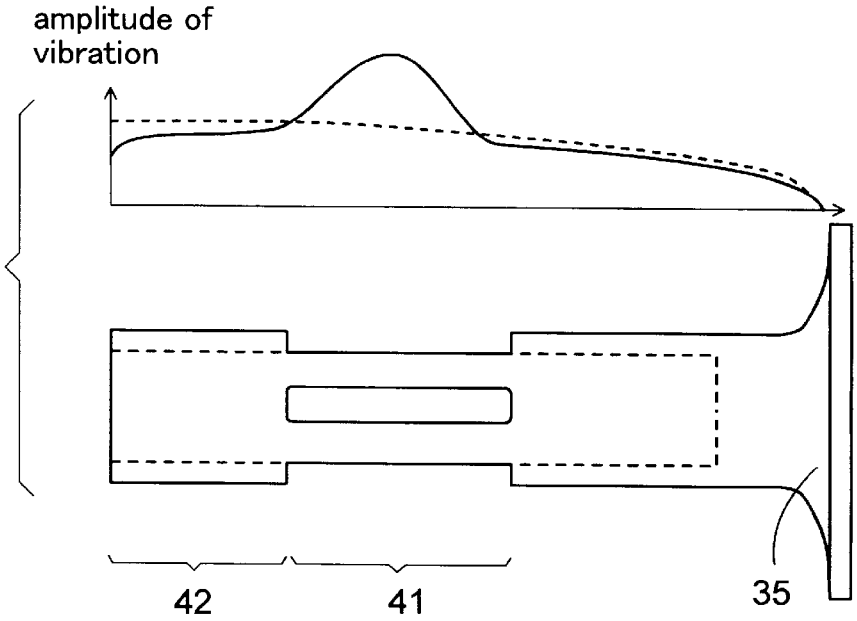
FIG. 9 is an explanatory view illustrating amplitude distribution along the axial direction of the hollow barrel of FIG. 7.

FIGS. 7 and 8 illustrate another embodiment of the present invention in which the hollow barrel 40 is formed in its axial center with a plurality of circumferentially spaced slits 50 in order to provide the hair winding zone 41 of the reduced cross-section. Formed between the adjacent ones of the circumferentially spaced slits 50 are reeds 51 which vibrate in the radial direction as well as in the axial direction, for improving the hair curling. As shown in FIG. 9, it is also made in the present invention to give a larger amplitude of vibration (indicate by a solid line) at the hair winding zone 41 than at the distal region 21 and to have a maximum amplitude of vibration larger than in the case (indicate by dotted lines) where no slit is formed. The amplitude of vibration illustrated in the figure is a sum of the amplitude of vibrations in the axial direction and in the radial direction.

A length L of slit 50 is selected so that the reeds 51 vibrate at a resonant frequency of the horn 30 in a loaded condition where the hair winding zone 41 receives the strand of the hair and vibrate at a frequency higher than the resonant frequency in a no-load condition, and is determined by the following equation:

$$L^2 = \frac{k^2}{2\pi f}\sqrt{\frac{E \cdot I}{\rho \cdot A}}$$

wherein k is a vibration coefficient, $f$ is a vibration frequency (Hz), E is a vertical compliance (Pa), I is a secondary moment ($m^4$), $\rho$ is a specific gravity ($kg/m^3$), and A is a cross-section ($m^2$) of a single reed between the slits. The vibration coefficient k may be selected from a primary vibration coefficient (k=4.730), a secondary vibration coefficient (k=7.853), or a third vibration coefficient depending upon the length L ($\lambda/4$ or $3\lambda/4$) from the flange 33 to the front end of the hollow barrel 40. In this embodiment, the length L is set to be about 11 mm.

Figure 10:
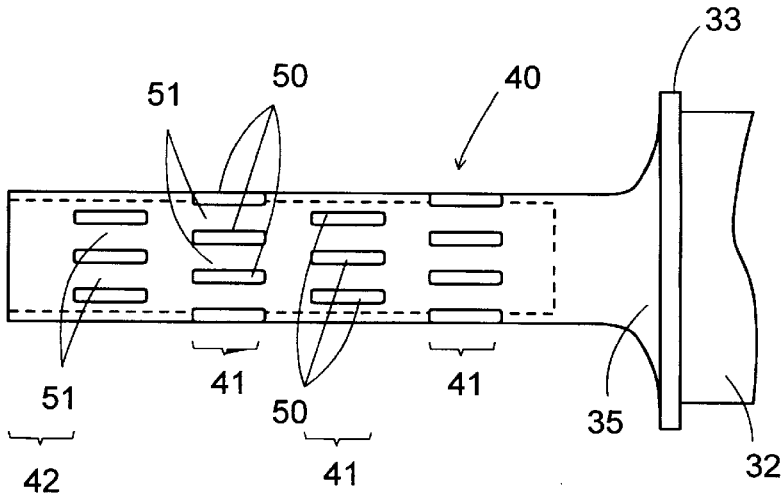
FIGS. 10 and 11 are front view of still other hollow barrels which may be employed in the above ultrasonic hair curling device.

As shown in FIG. 10, it is equally possible to provide more than one array of the circumferentially spaced slits along the axial direction in order to widen the hair winding zone 41. In this case, the slits 50 or reeds 51 in one array are preferred to be staggered with respect to the slits or reeds in the adjacent array for maintaining a strength of the hollow barrel 40. When more than one array of the slits are formed, the hollow barrel 40 may have a length L=$3\lambda/4$.

Figure 11:
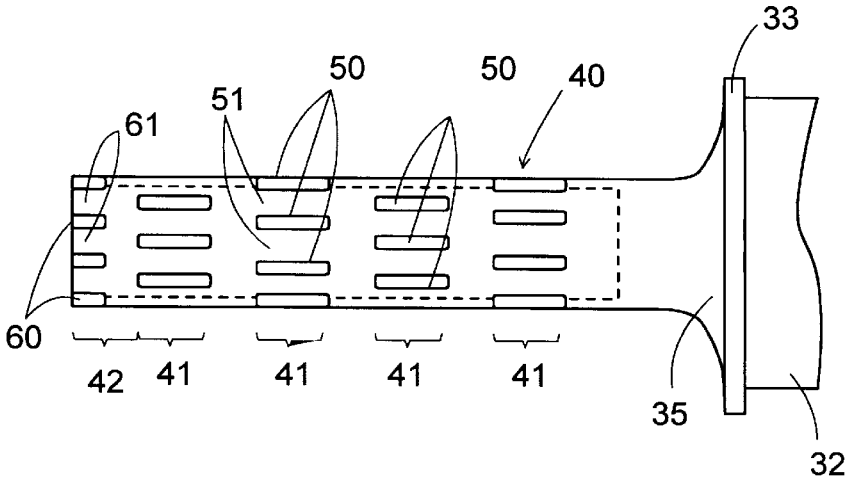

FIG. 11 shows a modification in which a plurality of circumferentially spaced open slits 60 are formed in the distal region 42 to give additional reeds 61 between the adjacent open slits 60. In this case, the additional reeds 61 capable of vibrating in the axial direction makes it possible to treatment of the hair even at the distal area 42. The open slit 60 has a length which is determined by the above equation for the slit 50, but is smaller than that of the closed slit, as shown in the figure because of that the additional reed 61 acts as a cantilevered beam to reduce the vibration coefficient k. In this instance, the vibration coefficient may be selected from a primary vibration coefficient (k=1.875), a secondary vibration coefficient (k=4.964) or a third vibration coefficient (k=8.885) depending upon the length of the hollow barrel 40.

Figure 12A:
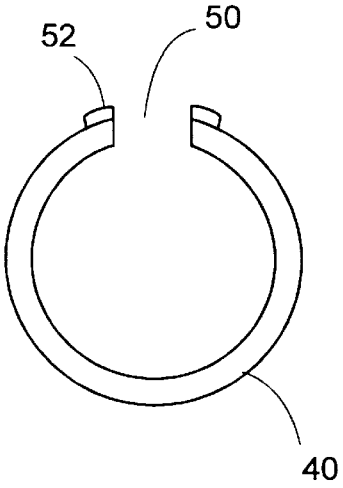
FIGS. 12A, 12B, and 12C are sectional views of reinforcement frames adapted around the periphery of a slit in the above hollow cylinder.
Figure 12B:
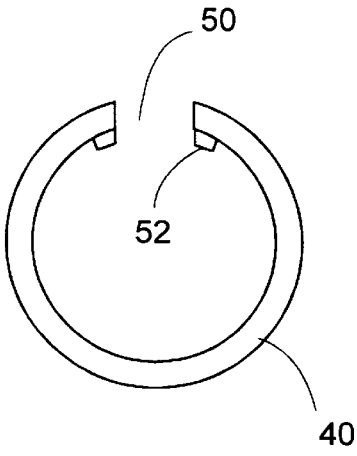
Figure 12C:
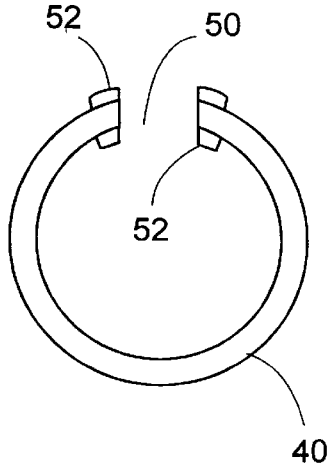

It is noted here that the slit is preferred to have rounded corners in order to avoid stress concentration thereat. Further, as shown in FIGS. 12A to 12C, a reinforcement frame 52 may be formed around at least one of the outer and inner perimeters of the slit 50, in order to give an added thickness to the perimeter of the slit, while keeping the reduced cross-section of the hair winding zone.

Although the above embodiments shows the slits which are aligned in the axial direction of the hollow barrel, the slits may be inclined with respect to the axial direction at an angle of suitable range.

What is claimed is:

1. An ultrasonic hair curling device comprising:

a housing;

an ultrasonic generator incorporated in said housing for generating ultrasonic vibrations;

a horn connected to receive and transmit said ultrasonic vibrations, said horn including a hollow barrel which projects from said housing for receive therearound a strand of hair to be curled;

wherein said hollow barrel is provided at a portion intermediate its longitudinal ends with a hair winding zone of which cross-section is smaller than the other portion of said hollow barrel.

2. The ultrasonic hair curling device as set forth in claim 1, wherein said hair winding zone is configured to have a cross-section which is smaller towards a lengthwise center of said hair winding zone than at opposite lengthwise ends of said hair winding zone.

3. The ultrasonic hair curling device as set forth in claim 1, wherein said hair winding zone has a uniform cross-section over its full longitudinal length thereof.

4. The ultrasonic hair curling device as set forth in claim 1, wherein said hair winding zone of reduced cross-section is realized by a recess formed in at least one of outer and inner surfaces of said hollow barrel.

5. The ultrasonic hair curling device as set forth in claim 1, wherein said hair winding zone of reduced cross-section is realized by provision of a plurality of slits which extend in the axial direction of said hollow barrel and which are spaced circumferentially around said hollow barrel to define between the circumferentially adjacent slits reeds which vibrate in a radial direction as well as in the lengthwise direction of said hollow barrel, each of said slits having such a length that causes said reeds to vibrate around at a resonant frequency of said horn when the strand of hair is wound around said hair winding zone.

6. The ultrasonic hair curling device as set forth in claim 5, wherein said slit has such a length that causes said reeds to vibrate at a frequency higher than the resonant frequency of said horn in a no load condition where said hair winding zone receives no strand of hair.

7. The ultrasonic hair curling device as set forth in claim 5, wherein a plurality of slit groups each composed of said circumferentially spaced slits are formed in said hollow barrel along the length thereof, the slits in one slit group being longitudinally aligned with the slits in the adjacent slit group.

8. The ultrasonic hair curling device as set forth in claim 5, wherein a plurality of slit groups each composed of said circumferentially spaced slits are formed in said hollow barrel along the length thereof, the slits in one slit group being staggered in the circumferential direction with respect to the slits in the adjacent slit group.

9. The ultrasonic hair curling device as set forth in claim 5, wherein each of said slits is configured to have rounded corners.

10. The ultrasonic hair curling device as set forth in claim 5, wherein each slit has its periphery surrounded by a reinforcement frame which gives an additional thickness to said periphery of the slit.

11. The ultrasonic hair curling device as set forth in claim 5, wherein said hollow barrel is additionally formed at its front end with a plurality of open slits which extend in the lengthwise direction of the hollow barrel and open at the front end, said open slits being spaced circumferentially around said hollow barrel to define additional reeds between the circumferentially adjacent open slits, said additional reeds vibrating in the radial direction as well as in the lengthwise direction of said hollow barrel.

* * * * *